United States Patent [19]

Gentile, Jr. et al.

[11] Patent Number: 4,849,053

[45] Date of Patent: Jul. 18, 1989

[54] METHOD FOR PRODUCING PULP USING PRE-TREATMENT WITH STABILIZERS AND DEFIBRATION

[75] Inventors: Victor M. Gentile, Jr., Morton; Harry D. Wilder, Elverson, both of Pa.

[73] Assignee: Scott Paper Company, Philadelphia, Pa.

[21] Appl. No.: 283,682

[22] Filed: Dec. 13, 1988

Related U.S. Application Data

[63] Continuation of Ser. No. 122,081, Nov. 18, 1987, abandoned, which is a continuation of Ser. No. 778,457, Sep. 20, 1985, abandoned.

[51] Int. Cl.[4] ..... D21C 1/04; D21C 3/26

[52] U.S. Cl. ..... 162/76; 162/78; 162/80; 162/84

[58] Field of Search ..... 162/80, 90, 72, 23, 162/25, 26, 76, 78, 84, 96, 97

[56] References Cited

U.S. PATENT DOCUMENTS 4,187,141 2/1980 Ahrel ..... 162/78
4,311,553 1/1982 Akerlund ..... 162/23

FOREIGN PATENT DOCUMENTS 2704758 8/1977 Fed. Rep. of Germany ..... 162/78

*Primary Examiner*—Steve Alvo
*Attorney, Agent, or Firm*—Nicholas J. DeBenedictis; John W. Kane, Jr.

[57] ABSTRACT

A method for producing novel pulp, primarily wood pulp, from chips using pre-treatment with stabilizers and alkaline peroxide prior to mechanical fiberization (refining) to increase the brightness of the resulting fibers and the papermaking strength achievable with the fibers. The novel aspect of the pre-treatment prior to refining is that it results in the "in situ" formation within the chips of a stabilizing flock or sol.

10 Claims, No Drawings

METHOD FOR PRODUCING PULP USING PRE-TREATMENT WITH STABILIZERS AND DEFIBRATION

BACKGROUND OF THE INVENTION

This application is a continuation, division, of application Ser. No. 122,081, filed on Nov. 18, 1987, now abandoned; which is a continuation of Ser. No. 779,457 filed on Sept. 20, 1985, of Gentile, et al. for High Yield Pulping and Bleaching Process, now abandoned.

Pulping processes can be broadly classified into high yield processes using mechanical fiberizing equipment and low yield processes using chemical reactions to produce individual fibers or pulp from lignocellulosic raw materials, usually wood in chip form. Within the high yield category there are many variations which involve varying combinations of chemical, mechanical, and thermal treatments to effect fiber separation, remove some lignin and other chemical components from the original fibers, or increase the brightness and papermaking strength of the resulting fibers. This invention is directed to the art of high yield pulping in which mechanical treatment either with or without heat is the primary means of fiber separation and mild chemical treatment is used to facilitate fiber separation and to increase the papermaking strength and brightness. The application of heat may be utilized in combination with mechanical and chemical treatments to further assist in fiber separation and to accelerate chemical reactions. However, the primary goal of this invention is to economically produce pulp in the highest possible yield of the orignal lignocellulosic raw material by retaining and chemically modifying the lignin in the fibers to obtain the desired papermaking properties.

Mechanically refined pulp without chemical pretreatment results in extremely high yeilds (about 95% or higher) but results in fibers containing almost all of the original lignin in essentially a chemically unmodified form. Such unmodified lignin imparts relatively low brightness to the fibers, and, due to its hydrophobic nature, the lignin inhibits the development of paper strength through fiber to fiber bonding (hydrogen bonding) and makes the fibers much stiffer than partially or completely delignified fibers from the same lignocellulosic raw material. Although some high yield pulps containing high amounts of lignin can be bleached economically to relatively high brightnesses using oxidizing agents such as alkaline peroxide and/or reducing agents such as sodium hydrosulfite, such post-refining treatments do not increase papermaking strength to levels required for many end uses because much mechanical damage has already been done to the fibers.

The papermaking strength of high yield pulps can be increased by sulfonation of the lignin, particularly when the wood chips are treated with the sulfonation chemicals (usually sodium sulfite and sodium hydroxide) prior to mechanical defibration (refining). In some cases, the resulting fibers can also be bleached economically as with alkaline peroxide and/or sodium hydrosulfite to give both improved brightness and papermaking strength. However, the high levels of sulfonation required for high strength result in pulps which respond less to bleaching than similar non-sulfonated or low-sulfonated pulps, and therefore such highly sulfonated pulps have lower bleached brightnesses although high strength. Moreover, sulfonation processes require the removal and disposal of environmentally objectionable sulfur compounds from process waste streams. In addition, the need for separate sulfonation, refining, post-refiner bleaching, and effluent treatment equipment makes the capital equipment and operating costs for such a system very significant.

An alternative to sulfonation of lignin for increasing papermaking strength of high yield fibers is carboxylation of lignin with oxidants such as alkaline peroxide prior to and/or during defibration. As sulfonation results in lignin containing sulfonate groups, likewise, carboxylation results in lignin with carboxylate groups. Both the sulfonate and the carboxylate groups are capable of participating in hydrogen bonding which increases the strength of paper made from such high yield pulps (papermaking strength).

Similar to the alkaline sulfonation treatment of chips prior to refining, alkaline peroxide pretreatment of chips softens the lignocellulosic raw material resulting in easier fiber separation (less energy consumption) and less fines generations (fiber fragmentation) during refining. In addition, refiner bleaching with alkaline peroxide can potentially eliminate the need for separate post-refiner bleaching equipment, due to the facts that refiners are excellent mixers of pulp and bleaching agents, and the temperature within the refiner (about 100° C.) causes bleaching to occur extremely fast relative to typical post-refiner alkaline peroxide bleaching steps (approximately 50° to 80° C.).

Offsetting the advantages is the primary drawback to alkaline peroxide refiner bleaching of peroxide decomposition. Peroxide decomposes to form oxygen (ineffective for lignin-retaining bleaching) under the highly alkaline conditions required for papermaking strength development. Peroxide decomposition is hastened by the high temperature reached in refiners and by metal contaminants, particularly manganese, iron, and copper, which are contained in significant quantities in lignocellulosic raw materials and in lesser quantities in process water. Partial removal or inactivation of such metal contaminants in lignocellulosic raw material can be effected by introducing chelating agents into the wood chips and then removing the chelant-metal complexes. However, the physical entrapment and chemical attraction of such metals by fiber components within the chips make complete removal of the metals impossible.

The problems associated with prerefiner or in-refiner alkaline peroxide treatments are partially avoided by post refiner alkaline peroxide treatments. For example, removal of metal contaminants from individual fibers with chelating agents after refining and prior to alkaline peroxide bleaching is much more effective because the particle size of the fiber in pulp is much smaller than chips before refining. The smaller size makes the metal contaminants much more accessible to the chelant solution. Consequently, in many cases the individual fibers can be bleached to much higher brightnesses with alkaline peroxide in a post refiner bleaching treatment without significant waste of peroxide bleaching agents due to metal contaminant induced decomposition of peroxide (U.S. Pat. No. 4,160,693-Lindahl et al.).

There have been many attempts to overcome such problems associated with the pre-refiner or in-refiner use of hydrogen peroxide in the production of high yield pulps. Control of alkalinity (e.g., see U.S. Pat. Nos. 3,069,309-Fennell and 4,270,976-Sandstrom et al., and Canadian Patent Nos. 1,078,558 and 1,173,604), control of the temperature (e.g., U.S. Patent No. 4,187,141-Ahrel), and control of time at high temperature (e.g., U.S. Pat. No. 4,270,976-Sandstrom et al.) have been tried. However, such techniques for reducing peroxide decomposition also reduce the effectiveness of alkaline peroxide in terms of the resulting pulp properties (papermaking strength) while the presence of deleterious metal contaminants still results in inefficient utilization of the peroxide bleaching agent during refiner bleaching.

Alkaline peroxide stablilzers like water soluble sodium silicate and magnesium sulfate are often utilized in the peroxide bleaching of high yield pulps to further reduce peroxide decomposition caused by metal contaminants. The silicate forms a flock in alkaline peroxide solutions and this flock attracts and adsorbes the metal ions on its surface thereby reducing their ability to decompose peroxide. Magnesium ions also reduce peroxide decomposition by electronically deactivating the metal ions, thereby reducing the potential of the metal ions to decompose peroxide. However, the present invention is based in part upon the belief that flocks or precipitates formed by silicates and/or magnesium in alkaline peroxide solutions cannot readily penetrate into the wood chip structure prior to refining due to the large size of the flock relative to the pore size of the wood chips. This belief is reinforced by the fact that such stablizers effectively stabilize peroxide against decomposition when pulp is being bleached with peroxide but are not as effective when the wood is in chip form rather than pulp. It is believed that the difference in stabilizer effectiveness when treating pulp fibers versus wood chips is due to the alkali and peroxide entering the chip structure while the stabilizer flock is impeded from penetrating the chip with the result that the peroxide, separated from the stabilizing flock, rapidly decomposes within the chip thereby reducing the amount of peroxide available for bleaching during refining. In adition, the pressure buildup within the chip due to the evolution of oxygen gas during peroxide decomposition forces alkaline peroxide out of the chip with the result that insufficient peroxide is retained in the chip as it enters the refining zone. Furthermore, irreversible alkaline yellowing of the pulp occurs if there is insufficient residual peroxide remaining with the pulp after refining.

A common method for circumventing the problem of peroxide decomposition in alkaline peroxide bleaching of chips during refining is to add the bleaching agent directly to the refining zone to minimize the contact time between the chip and alkaline peroxide, and in some cases to allow more intimate contact between metal contaminants and silicate and/or magnesium ion stablizer flocks (See for example, U.S. Pat. Nos. 3,023,140-Textor, 3,069,309-Fennell, 4,022,965-Goheen et al., 4,270,976-Sandstrom et al., 4,311,553-Akerlund et al.; Japanese Patent Application No. 80-72091, and Federal Republic of Germany Patent No. 2818-320). Additionally, wood chips have been pretreated by impregnation and/or refining with chelants (U.S. Pat. Nos. 3,023,140-Textor, 4,311,553-Akerlund et al., Japanese Patent Application No. 80-72091 ,and Federal Republic of Germany Patent No. 2818-320) or with sodium silicate (U.S. Pat. Nos. 3,069,309-Fennell, 4,311,553-Akerlund et al.,), or with magnesium salts (U.S. Pat. Nos. 3,023,140-Textor, 3,069,309-Fennell, 4,311,553-Akerlund et al. and Japanese Patent Application 80-72091) and combinations thereof prior to alkaline peroxide addition into the refiner to reduce peroxide decomposition. U.S. Pat. No. 4,270,976-Sandstrom et al. is the only case in which brightness comparable to post refiner alkaline peroxide bleaching was obtained but it utilized lower alkalinity as the means of reducing the peroxide decomposition rate which sacrificed good papermaking strength development. The present invention is based in part upon the hypothesis that with processes employing akaline peroxide addition directly into the refiner, the majority of defibration occurs before the alkali and peroxide contact the fibers and have an opportunity to sweel an react with the wood, thereby reducing the potential for papermaking strength development, along with requiring more energy for refining and increasing the generation of fines, all of which could be avoided if alkaline peroxide could be inserted and stablized within the chip prior to defibration.

Impregnation of the chips with alkaline peroxide prior to refining has also been practiced (U.S. Pat. Nos. 4,187,141-Ahrel, and 4,270,976-Sandstrom et al., and Canadian Patent Nos. 1,078,558, and 1,173,604). In most cases, the brightness obtained was comparable to that obtainable with post refiner alkaline peroxide bleaching. However, with such processes, metal contaminants are not removed or deactivated; rather, peroxide decomposition is reduced by lower alkalinity (U.S. Pat. Nos. 4,270,976-Sandstrom et al., Canadian Patent Nos. 1,078,558, and 1,173,604) or by mninimizing refining temperature (U.S. Pat. No. 4,187,141-Ahrel). However, the lowering of the alkalinity or temperature causes less papermaking strength to be developed than sulfonation methods. At higher alkalinity, strengths comparable to those of post refiner bleached, sulfonated high yield pulps were obtained but at the expense of lower brightness due to increase peroxide decomposition (Canadian Patent No. 1,078,558).

THEORY OF THE INVENTION

The present invention is based in part upon the theory that refining of chips impregnated with highly alkaline peroxide can be practiced to achieve both high brightness and high strength if stablizers such as magnesium ions and silicate are impregnated into the chip in a manner to form a stabilizer flock "in situ" within the chip to stabilize alkaline peroxide within the chip. The benefits derived are:

(a) higher strength than can be achieved with relatively low sulfonation processes;

(b) higher brightness than can be achieved with high sulfonation processes or sulfonation/carboxylation processes that produce pulps with high papermaking strengths;

(c) low refining energy required; and (d) lower capital and operating expenses than those associated with alkaline peroxide bleached sulfonated fibers due to less equipment for strength formation, bleaching, and effluent treatment.

SUMMARY OF THE INVENTION

This invention produces novel fibrous pulps from lignocellulose-containing materials such as softwoods, hardwoods, bagasse, straw, and similar fibrous materials which have been chopped or cut into pieces suitable for pulping (hereinafter referred to as "Chips") prior to reduction into individual fiber form. Chips are usually in the size range of less than 3 centimeters average diameter but can vary. Suitable hardwoods include Aspen, Gmelina, Eucalyptus, Birch, Beech, Oak and Ash. Suitable softwoods include Pine, Spruce, Fir and Hemlock.

In accordance with the theory of the present invention the lignocellulosic raw material in pieces referred to in the art as chips is treated to produce novel pulp according to the following sequence: (A) chips (usually pretreated with steam and/or washed and soaked in water) are impregnated with a first impregnation solution containing stabilizing chemicals for peroxide (such as a solution containing silicate or magnesium ions and optionally a chelating agent) under conditions of pH, temperature, and concentration for the stablizing chemicals so that they remain soluble in the first impregnation solution; (B) the chips are impregnated with a second impregnation solution containing the additional stabilizing chemicals, e.g., silicate or magnesium ions, and optionally a chelating agent under conditions of pH, temperature, and concentration so that the chemicals are soluble in the second impregnation solution but precipitate and/or form a flock for stablizing peroxide when mixed with the first impregnation solution within the chips; and (C) the chips are impregnated with a third impregnation solution containing alkaline peroxide with or without stabilizers and/or chelating agents. Impregnation steps can be accomplished by squeezing the chips to expel excess liquids and air followed by allowing the chips to expand into the impregnation solution. Optionally, impregnation solutions of steps B and C can be combined into a single impregnation solution and impregnation step. The alkaline peroxide impregnated chips are then refined in one or more stage(s) under atmospheric pressure or superatmospheric pressure. The refining pressure is usually associated with steam added to or generated within the refining device. The resulting pulp is dewatered and acidified and/or washed to remove bleaching and stabilizing chemicals to result in a novel non-sulfonated pulp having a unique combination of properties including high yield, superior brightness and papermaking strength, and low fines content. Recyclable peroxide is obtained from the dewatering of the pulp after refining and preferably before acidification. The peroxide obtained from the post refiner dewatering step can be reused as makeup in the impregnation step in which peroxide is added to the chips.

DETAILED DESCRIPTION OF THE INVENTION

This invention is useful in producing fibrous pulps from lignocellulosic raw materials such as softwoods, hardwoods, bagasse, straw and other similar fibrous materials which have been chopped or cut into appropriate sized pieces known in the art as chips for pulping into individual fiber form. The resulting high yield (yield of 80% or higher of the original lignocellulosic raw material) non-sulfonated pulp has properties equal to or superior to sulfonated pulps prepared in similar yields from the same lignocellulosic raw materials. These properties are high brightness and paper-making strength, and low fines content. Additionally, the process has the advantages of lower capital and operating costs to produce pulps of equal or better quality than comparable sulfonated pulps because of lower equipment cost for the pulping and waste treatment processes, and lower operating costs due to less chemical usage, lower refining energy, and easier treatment of process effluents. As used herein all parts are by weight unless otherwise specified, and all parts based upon the weight of chips are based upon oven-dried weight of the chips.

Preferred Method for Pretreating and Impregnating Chips

Prior to the first impregnation step, the chips are preferably saturated with water and/or steam to expel any entrapped air in accordance with conventional procedures. Before and as a part of each impregnation step, the chips are preferably squeezed to expel liquid and any remaining air, and then allowed to expand into the impregnation solution so as to absorb the impregnation solution. The quantity of solution absorbed is influenced by the impregnation device and the particular material being impregnated. The level of chemical addition into the chips is primarily controlled by the concentration of the particular chemical in the impregnation solution, the degree of chip compression in the impregnation device, and the density of the chips being treated.

The first impregnation solution is an aqueous solution consisting of stabilizers for peroxide and optionally chelating agents and has a pH, temperature, and concentration so as to avoid precipitation of the solutes in the impregnation solution. If a chelating agent is used in the first impregnation solution to effectively chelate deleterious metal ions like manganese, iron, and copper, the pH, temperature and concentration should also be selected to impede the chelant from combining with or inactivating the stabilizers. In the first impregnating solution it is preferred to use magnesium sulfate as the stabilizer but other stabilizers can be used such as water soluble magnesium salts (e.g., magnesium chloride, magnesium nitrate, magnesium carbonate, and combinations thereof). In addition, it is preferred to use chelating agents or complexing agents in the first impregnation solution such as diethylene triaminepentaacetic acid (DTPA), ethylene diaminetetraacetic acid (EDTA), hydroxyethylethylenediaminetriacetic acid (HEEDTA), nitrilotriacetic acid (NTA) sodium tripolyphosphate (STPP), and phosphonic acid derivatives or other similar compounds known in the art for such functionality. The concentration of magnesium salt in the impregnation solution is preferably between 0.01 and 2.0 grams per liter calculated based upon the weight of magnesium in the salt so as to result in a magnesium content of the chips equivalent to preferably from 0.001% to 0.2% of the weight of chips. If used, the chelating agent concentration in the impregnation solution should be preferably from 0.01 gram per liter to 20 grams per liter (expressed as 100% chelating agent in the solution) to give preferably 0.001% to 2.0% chelant based on the dry weight of chips, but chelant concentration and addition level may extend beyond such ranges depending upon the specific chelating agent and the quantity and species of metal contaminants contained in the chips. The temperature of the first impregnation step is preferably between 15° C. and 100° C. (100° F. and 212° F.). The pH is preferably between 5 and 10 with between 7 and 9 being most preferred. Adjustments to the solution pH can be made with any suitable acid or alkaline substance which does not react with peroxide, cause darkening of the chips, or cause any of the components of the impregnation solution to be precipitated or to lose stabilizing and/or chelating ability. The pH, temperature and concentration ranges given above were selected to avoid preciptiation of magnesium ions in the solution and to minimize interaction between magnesium ions and the chelant.

The second impregnation solution is an aqueous alkaline solution which also consists of stabilizers for peroxide and optionally chelating agents and is at a pH, temperature, and concentration so as to avoid precipitation of the solutes before entering the chip, and if a chelating agent is used, so as to effectively chelate deleterious metal ions like manganese, iron, and copper but not combine with or deactivate the stabilizers to any significant extent. The critical aspect of the present invention is that the pH, temperature, and concentration of the components in the second impregnation solution be suitable for formation of a stabilizer flock after the solution enters the chips and mixes with already impregnated chemicals from the first impregnation step. This results in the "in situ" formation of stabilizing flock for the peroxide within the chips. In the second impregnation solution it is preferred to use sodium silicate, especially a 40–42 degrees Baume' sodium silicate solution with 28.7% $SiO_2$ and 8.9% $Na_2O$ although there are suitable substitutes recommended by silicate manufactures for alkaline peroxide bleaching. In addition, it is preferred to use chelating agents in the second impregnatation solution of a type and in concentration and addition level ranges based upon the weight of the chips as described previously for the first impregnation solution. The concentration of sodium silicate in the second impregnation solution is preferably between 1.0 and 100 grams per liter calculated and expressed as silicon dioxide ($SiO_2$). The temperature of the second impregnation step is preferably between 15° C. and 100° C. (60° C. and 212° F.), and the pH is higher than the pH of the first impregnation solution and preferably greater than 9 with from 9 to 12 being particularly preferred and between 10 and 11 being most preferred. Adjustment to the solution pH can be made in the same manner as described for the first impregnation solution. Preferably, the second impregnation of the chips results in between 0.1% and 10% silicates, calculated as $SiO_2$ based upon the dry weight of the chips.

The third impregnating solution is an aqueous alkaline peroxide solution which may also contain a combination of the stabilizers employed in the first and second impregnation solution primarily for stabilizing the peroxide outside the chips. Preferably the third impregnation solution contains magnesium and silicate stabilizers, and optionally chelating agents of the types and in concentrations and addition levels described for the first and second impregnation solutions. The third impregnation solution contains preferably hydrogen peroxide or any other peroxygen compound suitable for bleaching, in the concentration range of preferably between 10 and 100 grams per liter (calculated and expressed as hydrogen peroxide) to give addition levels of preferably between 0.5% and 10% of the weight of chips expressed as hydrogen peroxide. In addition, an alkaline substance (preferably sodium hydroxide) is added to the third impregnation solution to give a solution pH preferably in the range between 9 and 13 with between 11 and 12.5 being most preferred. The temperature of the third impregnating solution is preferably between 15° C. and 100° C. (60° F. and 212° F.).

The most preferred impregnation sequence is the three stage sequence previously described and presented in more detail in the examples. However, it should be understood that the invention is not limited to the generally described three stage sequence. The second most preferred embodiment of the invention is a two-stage impregnation sequence in which the first impregnation stage is practiced as previously described and the second impregnation solution is combined with the third impregnation solution (alkaline peroxide) and used in a single impregnation step at a pH from 9 to 13. Reversing the solutions by using the first impregnation solution in the second impregnation step and the second impregnation solution in the first impregnation step of the three impregnation sequence described above is the third most preferred embodiment of the invention. That is the first impregnation solution description appearing on pages 9 and 10 becomes the description of the second impregnation solution and likewise the description of the second impregnation solution on pages 11 and 12 becomes the description of the first solution.

The key aspect in all the above sequences is that one component of the stabilizing flock be in the first impregnation solution and a second component be in the second impregnation solution so that the two components form the flock within the chip when the two solutions mix during the second impregnation. With some stabilizers, it is possible for the second component to be a base that results in a pH adjustment upon mixing of the first and second solutions in the chip to result in the "in situ" formation of the flock or sol. In addition, the invention is not limited to the concentration and addition level ranges previously described for stabilizers and chelating agents, since differences in metal contamination levels of lignocellulosic raw materials and/or process water could justify stabilizer or chelating agent usages outside of the specified preferred ranges.

Refining of Chips (Defibration)

The chips are mechanically refined in a suitable defibration apparatus in one or more stages in accordance with conventional processes and equipment. The pressure during refining is optional and can be be at atmospheric and/or superatmospheric pressure, depending on the species being pulped and the desired pulp properties. Superatmospheric pressure refining (particularly useful in first stage refining) does increase the papermaking strength, and decrease refining energy and fines generation but at the expense of higher peroxide usage and lower brightness compared to atmospheric refining. The effect on papermaking strength and fines generation is particularly pronounced when the raw material is softwood as contrasted with hardwood.

Post-Refining Steps

After refining, the pulp may be allowed to continue bleaching as long as is practical prior to expelling the impregnation solutions. The amount of peroxide used in the impregnation steps is preferably preselected to result in some residual peroxide remaining after refining in order to maintain high brightness. Preferably the refined pulp is concentrated, e.g., by compressing or thickening, to remove residual impregnation solution containing potentially recyclable alkaline peroxide, then cooled and diluted with water, and acidified perferably with sulfur dioxide, sodium bisulfite, or sulfurous acid to a pH between 5.5 and 6.0, and then washed with water. The residual peroxide extracted from the pulp after refining can be recycled as a source of peroxide in one of the impregnation solutions particularly if the process is practiced continuously or in sequential batches. The washed pulp is preferably screened and cleaned to result in a pulp suitable for the production of paper products.

EXAMPLES A, 1 and 2

Examples A, 1 and 2 compare the process of the present invention with a single step conventional process utilizing the same chemicals. The amount of refining was adjusted to result in comparable pulps in terms of pulp freeness.

Southern U.S.A. Pine wood chips were used in Examples A, 1 and 2. The chips were of a size that would pass through a ¾" circular hole screen (1.9 cm). Prior to impregnation, the chips were steamed at atmospheric pressure for 30 minutes and then washed with water and drained. To accomplish each impregnation stage in Examples A, 1 and 2, a Sprout-Waldron Model LI-12 labotatory impregnator was used at a 4:1 compression ratio. The impregnator has a perforated cylinder with a movable piston inside the cylinder and a removable plug at one end of the cylinder. The impregnator is operated as follows:

(1) Chips are placed inside the cylinder with the plug in place and the initial volume of the chips in the cylinder is determined, (2) The piston is moved to compress the chip mass from its initial volume to a final volume. Any liquid squeezed out of the chips during this compression is allowed to drain through the perforated cylinder wall and out of the equipment. The ratio of the initial volume of chips to the final volume is defined as the compression ratio and in the following examples the compression ratio was 4:1 unless otherwise noted, (3) Impregnation solution is added to cover all of the chips in the cylinder and the compression piston is moved back and forth several times to help purge trapped air from the mass of compressed chips, (4) The cylinder plug is removed and compressed chips are pushed out of the cylinder and allowed to expand while still in contact with the impregnation solution, and the expanded chips are allowed to remain in contact with the solution for about 10 minutes at a temperature of 25° C. to 30° C., and (5) The impregnated chips are drained of free impregnation solution.

EXAMPLE 1

For Example 1, two impregnation stages were used.

The first impregnation solution was a water solution containing: 5.28 grams/liter of Epsom salts, technical grade (magnesium sulfate heptahydrate—$Mg\ So_4.7H_2O$); 4.0 grams/liter of the penta sodium salt of diethylenetriamine pentaacetic acide (hereinafter DTPA and available as Versenex 80 TM from Dow Chemical Company) and sufficient hydrochloric acid to adjust the pH to 9.0. Impregnation of the Southern pine chips was accomplished with the Sprout-Waldron impregnator as described above.

The second impregnation solution was a water solution containing: 5.28 grams/liter of Epsom salt; 0.4 grams/liter of DTPA; 42.2 grams/liter of sodium silicate solution (a 41° Baume' solution, 28.7% $SiO_2$ and 8.9% $Na_2O$, available as type "N" from P Q Corporation hereinafter referred to as "sodium silicate"); 50 grams/liter of sodium hydroxide (technical grade); and 60 grams/liter of hydrogen peroxide (added as a stabilized 50% $H_2O_2$ solution, technical grade). The resulting solution had a pH of 11.7.

The chips were then refined at atmospheric pressure in a Sprout-Waldron 12" laboratory refiner, Model 12-1CP. The disk space and the feed rates of chips into the refiner were adjusted as appropriate for the desired energy input.

After refining, the pulp was dewatered to 25% to 35% consistency, diluted to about 3% consistency, and the pH of the resulting pulp slurry was adjusted to between 5.5 and 6.0 with sulfurous acid ($H_2SO_3$) before the pulp properties were tested. The resulting pulp was tested for brightness and the total amount of hydrogen peroxide consumed in the Example was determined. The results are given in Table I. The dewatering to 25% to 35% consistency after refining yielded recyclable hydrogen peroxide. The "in situ" formation of stabilizing flock within the chips occured during the second impregnation of the chips as a result of the mixing of the first and second impregnation solutions within the chips.

EXAMPLE 2

In Example 2 the same impregnation procedures, equipment and chemicals in the same total quantities were used in Example 1. The main change in Example 2 versus Example 1 is that the chemicals were divided among three impregnation steps rather than two. The additional step between the first and second steps of Example 1 impregnates some of the sodium silicate at an alkaline pH into the chips to form a stabilizing flock "in situ" prior to the addition of the hydrogen peroxide in the third impregnation.

The first impregnation solution for Example 2 was identical to the first impregnation solution in Example 1 and the same impregnating conditions, procedures and equipment were employed as in Example 1.

The second impregnation solution was a water solution containing 21.1 grams/liter of sodium silicate and 0.4 grams/liter of DTPA and had a pH of 10.7. The same conditions, procedures and equipment were employed for impregnation as described in Example 1.

The third impregnation solution was an aqueous solution containing 5.28 grams/liter of Epsom salt, 0.4 grams/liter of DTPA, 21.1 grams/liter sodium silicate solution, 50 grams/liter of sodium hydroxide, and 60 grams/liter of hydrogen peroxide (added as a stabilized 50% $H_2O_2$ solution) and had a pH of 11.7.

The chips from the third impregnation step were refined, and the resulting pulp was treated after refining as in Example 1. The pulp was tested for brightness and the amount of hydrogen peroxide consumed was determined. The results are given in Table I.

EXAMPLE A

In Example A the same impregnating procedures, chemicals and equipment were used as in Example 1 and 2 except that a single impregnation step was used containing all of the chemicals used in Example 1 and 2 but the amount of DTPA was reduced because the higher levels of DTPA would be incompatible and react with hydrogen peroxide when combined in a single solution.

The impregnation solution was a water solution containing 10.56 grams/liter of Epsom salt, 0.4 grams/liter DTPA, 42.2 grams/liter sodium silicate solution, 50 grams/liter sodium hydroxide and 60 grams/liter of hydrogen peroxide (added as a stabilized 50% $H_2O_2$ solution) and had a pH of 11.7.

After the impregnation step, the chips from Example A were refined, and the resulting pulp was treated after refining as in Example 1. The pulp was then tested for brightness and the amount of hydrogen peroxide consumed was determined. The results are given in Table I.

Comparison of Results from Examples A, 1 and 2

Example A consumed 7.5% hydrogen peroxide based on the dry weight of the wood chips but achieved a brightness of only 60% (Elrepho brightness). In contrast, with the same chemicals the two-step impregnation sequence of Example 1 achieved a brightness of 72% Elrepho while only consuming 4.2% hydrogen peroxide based on the dry weight of the wood chips. The preferred method of practicing the present invention with the three-step impregnation sequence of Example 2 consumed only 3.7% hydrogen peroxide based on the dry weight of the wood chips and achieved the highest brightness of 75% Elrepho.

EXAMPLES 3, B and C

Pulp produced from Southern Pine chips using the preferred three-stage sequence in Example 3 was compared with pulp produced by a high sulfonation CMP process (Example B) and pulp produced by a low sulfonation CTMP process (Example C) and utilizing commercial scale equipment.

In Examples 3, B and C the same source of lignocellulosic chips (Southern Pine chips passing through ¾" circular screens) was used as in Examples A, 1 and 2. The chips were pretreated with atmospheric steam for 30 minutes. For all impregnations of Examples 3, B and C, a CE-Bauer Model 560GS Impressafiner was employed. It is a tapered screw press using a 4:1 compression ratio and achieves a temperature of 40° C. to 60° C. during impregnation due to heat generated within the equipment. After impregnation, the chips were allowed to drain of free impregnation liquor. After all the impregnation steps were completede for each Example, the chips were refined under steam pressure of 25 lbs/inch$_2$ gage (psig) in a CE-Bauer Model 418 pressurized refiner and then subjected to secondary refining at atmospheric pressure in a CE-Bauer Model 401 atmospheric refiner. The refiner plate spacing and feed rates were adjusted as appropriate for the energy input and degree of refining which was selected to result in comparable pulps in terms of freeness. After refining the refined pulp was diluted to about 3% consistency, and the pH of the resulting pulp slurry was adjusted to between 5.5 and 6.0 with sodium bisulfite ($NaHSO_3$).

EXAMPLE 3

A three-stage impregnation sequence was employed. The first impregnation solution was a water solution containing 4.4 grams/liter of Epsom salts, 0.4 grams/liter of DTPA and had a pH of 8.3. The second impregnation solution contained 17.6 grams/liter sodium silicate and 0.4 grams/liter DTPA, and had a pH of 10.6. The third impregnation solution contained 4.4 grams/liter of Epsom salt, 0.4 grams/liter of DTPA, 17.6 grams/liter sodium silicate, 60 grams/liter sodium hydroxide and 50 grams/liter hydrogen peroxide and had a pH of 11.9. The pulp produced was tested for brightness, freeness (Canadian standard freeness) and strength (breaking length). Results are given in Table II.

EXAMPLE B (CMP PROCESS WITH POST-REFINING PEROXIDE BLEACHING)

The liquor used in the impregnation stage contained 58 grams/liter $SO_2$ (achieved with a mixture of sodium sulfite and sodium bisulfite) and had a pH of 7.4. A sufficient amount of solution was retained in the chips after impregnation of result in 6.3% $SO_2$ applied to the chips in the Impressafiner. After impregnating the chips, the chips were cooked in a digester with a 4:1 liquor to wood ratio at 160° C. for 30 minutes and then the chips were drained of cooking liquor. The cooking liquor contained 59 grams/liter $SO_2$ (achieved with a sodium sulfite and sodium bisulfite mixture) and had a pH of 7.4. This resulted in 6.0% $SO_2$ applied to the chips in the digester to result in a total $SO_2$ application to The chips of 12.3% in the impregnation and cooking steps. The chips were then refined in the same manner as in Example 3 and after refining the pulp was dewatered, washed with water and bleached. Bleaching consisted of treating the pulp for 10 minutes at 3% consistency with 0.25% DTPA, dewatering to 25% to 30, consistency, then bleaching at a pH of 11 and at 60° C. with a peroxide bleaching solution at a consistency of 12.5% for three hours. The bleaching solution had 5.5% hydrogen peroxide, 5.0% sodium hydroxide, 4.5% sodium silicate, 0.05% Epsom salt and 0.35% DTPA, (all percentages being based upon the dry weight of pulp). After being bleached, the pulp was dewatered, diluted to a 3% consistency and the pH adjusted to about 5.5 with sulfurous acid. The bleaching conditions were selected to result in essentially the same consumption of peroxide as in Example 3. The pulp of Example B was tested for brightness, both before (initial) and after bleaching (bleached), freeness and breaking length and the results are given in Table II. The amount of energy consumed during refining is also in Table II.

EXAMPLE C (CTMP PROCESS WITH POST-REFINING PEROXIDE BLEACHING)

The Southern Pine wood chips were steamed at atmospheric pressure for 30 minutes, and then impregnated using the same equipment as in Example 3 with an impregnation liquor containing 64 grams/liter sodium sulfite and having a pH of 9.0 to result in 3.8% $SO_2$ applied to the chips based upon the dry weight of chips. After the impregnation step, the chips were subjected to atmospheric steam for 30 minutes. After impregnation and steaming, the chips were refined in the same manner as in Example 3. The resulting refined pulp was then dewatered, washed with water and bleached with peroxide. Bleaching consisted of pretreating the pulp for 10 minutes at 3% consistency with 0.25% DTPA, dewatering the pulp and then bleaching the pulp at 60° C. and 12.5% consistency for two hours with a bleaching solution having 4% hydrogen peroxide, 3.5% sodium hydroxide, 4.5% sodium silicate, 0.05% Epsom salt and 0.5% DTPA, (all percentages based upon dry weight of the pulp). After bleaching, the pulp was dewatered, diluted to a 3% consistency and the pH adjusted to 5.5 with sulfurous acid. The pulp was tested for brightness (both before and after bleaching), freeness and breaking length. The amount of energy consumed during refining was also determined. The results are stated in Table II.

Comparison of Results

The pulp of Example 3 was the brightest and required the lowest refining energy. It was much stronger than the pulp of Example C and brighter and almost as strong as the pulp of Example B.

EXAMPLES 4, 5 and D

Examples 4, 5 and D, were essentially a repeat of Examples 1, 2 and A (present invention compared with a single stage impregnation process using the same chemicals) but with hard wood (Aspen) rather than softwood.

In Examples 4, 5 and D, Aspen chips of a size that passes through a ¾" circular hole screen were used after being pretreated with atmospheric steam for 20 minutes and then washed with water. For impregnation, the Sprout-Waldron Model LI-12 with the same procedures and conditions were used as in Examples 1, 2 and A with the exceptions noted below. The same procedures for treatments, refining and testing were used in Examples 4, 5 and D as in Examples 1, 2 and A.

EXAMPLE 4 (TWO-STAGE IMPREGNATION SEQUENCE)

The first impregnation solution contained 3.52 grams/liter Epsom salt, 4.0 grams/liter DTPA and had a pH of 9 obtained by adding hydrochloric acid. The second impregnation stage used an aqueous impregnation solution containing 3.52 grams/liter Epsom salt, 0.4 grams/liter DTPA, 28.16 grams/liter sodium silicate, 55 grams/liter sodium hydroxide, 40 grams/liter hydrogen peroxide. It had a pH of 12.5.

After being subjected to the impregnation steps, the chips were refined at atmospheric pressure in the Sprout-Waldron 12" labortory refiner Model 12-1CP using the same procedures as in Example 1. After refining, the pulp was dewatered to a consistency between 25% and 35%, then diluted to about a 3% consistency and the pH of the resulting pulp slurry adjusted to between 5.5 and 6.0 with sulfurous acid. The pulp was then tested and the results are given in Table II. The dewatering resulted in a source of hydrogen peroxide that could be recycled by utilizing it in the makeup of an impregnation solution.

EXAMPLE 5

The same procedures, equipment and conditions were used as in Example 4 with the same chemicals except that the preferred three-stage impregnation sequence was employed with the following impregnation solutions:

An aqueous solution identical to the first impregnation solution of Example 4 was used as the first impregnation solution. An aqueous solution containing 14.08 grams/liter sodium silicate and 0.4 grams/liter DTPA and having a pH of 10.7 was used as the second impregnation solution. The third impregnation solution was an aqueous solution containing 3.52 grams/liter Epsom salt, 0.4 grams/liter DTPA, 14.08 grams/liter sodium silicate, 55 grams/liter sodium hydroxide and 40 grams/liter hydrogen peroxide. It had a pH of 12.5.

After the impregnation steps, the pulp was refined, dewatered and adjusted to a 3% slurry having a pH of between 5.5 and 6.0 with sulfurous acid and tested as in Example 4. The results are given in Table II.

EXAMPLE D

Example D was a single stage impregnation process using the same chemicals, procedures and equipment as in Examples 4 and 5 with the following exception. The impregnation stage of Example D employed an aqueous solution containing 7.04 grams/liter Epsom salt, 0.4 grams/liter DTPA, 28.16 grams/liter sodium silicate, 55 grams/liter sodium hydroxide and 40 grams/liter hydrogen peroxide. The pH was 12.5.

Comparison of Examples D, 4 and 5

Example D consumed 4.7% peroxide and achieved a brightness of 76%. Example 4 (2 stages) consumed 3.4% peroxide and achieved a brightness of 82% while the preferred three-stage sequence of Example 5 consumed only 1.5% peroxide and achieved the highest brightness (83%).

EXAMPLES E AND F

In Examples E and F, compared the preferred three-stage impregnation process of Example 5 to the CMP process with post refining peroxide bleaching (Example E) and with the high alkaline CTMP process with post refining peroxide bleaching (Example F).

EXAMPLE E (CMP WITH POST-REFINING PEROXIDE BLEACHING)

Aspen chips of the same type used in Example 5 were presoaked in water for 12 hours under vacuum which is equivalent to the presteaming of Example 5. The soaked chips were then pretreated in a digester by cooking the chips with a 4:1 liquor to chip ratio at 150° for 90 minutes in a sodium sulfite and sodium bisulfite cooking liquor at an initial pH of 6.9 which resulted in 6% $SO_2$ applied based on the dry weight of the chips. After 90 minutes of cooking, the chips were drained of free liquor and refined in the Sprout-Waldron laboratory refiner as in Example 5. After refining, the pulp was washed with water and then subjected to a post refining peroxide bleaching step which consisted of pretreating the pulp for 10 minutes at 3% consistency with 0.25% DTPA, dewatering the pulp and then bleaching the pulp at 60° C. and at a consistency of 12.5% for 2 hours in a bleaching solution containing 2% hydrogen peroxide, 3.3% sodium hydroxide, 5% sodium silicate, 0.5% DTPA and 0.05% Epsom salt and having a pH of 11.5 (all percentages based upon the dry weight of the pulp). After bleaching, the pulp was dewatered and diluted to 3% consistency and the pH adjusted to 5.5 with sulfurous acid prior to being tested. The test results are given in Table II.

EXAMPLE F (HIGH ALKALINITY CTMP PROCESS WITH POST-REFINING PEROXIDE BLEACHING)

The Aspen chips were presoaked as in Example E and then were impregnated in a digester under vacuum using a 13.3:1 liquor to wood ratio for 12 hours at a temperature of 30° C. The cooking liquor impregnated into the chips was a aqueous solution containing 15 grams/liter of $Na_2SO_3$ grams/liter of sodium hydroxide and had a pH of 12.9. This resulted in 1.7% $SO_2$ and 9.8% sodium hydroxide applied based on the dry weight of the chips. The chips were then drained of excess liquid and steamed at a pressure of 5 lbs/inch$^2$ gauge (psig) for 30 minutes. The treated chips were refined under steam at 15 lbs/inch$^2$ gauge pressure in the Sprout-Waldron 12" laboratory refiner Model 12-1C and then subjected to secondary refining in the same refiner at atmospheric pressure. After refining the pulp was dewatered, washed with water and subjected to hydrogen peroxide bleaching by first pretreating the pulp for 10 minutes at 3% consistency with 0.25% DTPA, dewatering the pulp and then bleaching the pulp at 60° C. for 2 hours at 12.5% consistency with a bleaching solution containing 3% hydrogen peroxide, 3.8% sodium hydroxide, 5% sodium silicate, 0.5%

DTPA, and 0.05% Epsom salt and having a pH of 11.5 (all percentages based upon the dry weight of the pulp). The bleached pulp was then dewatered, diluted to 3% consistency and the pH adjusted to 5.5 with sulfurous acid.

The pulp from Examples E, F and 5 were tested for brightness, freeness and strength (breaking length) and the engery consumed during refining was also determined. The results are shown in Table II. For Examples E and F, the brightness of the pulp was determined both before and after peroxide bleaching.

The pulp of Examples 5 was brigher and stronger than the pulps of Examples E and F and required substantially less energy to refine than in Example E.

EXAMPLES 6, G and H

The preferred three-stage impregnation process of the present invention was compared with CMP pulp subjected to post refining peroxide bleaching and compared with high alkalinity CTMP pulp subjected to post refining peroxide bleaching in order to substantiate the improved process of the present invention and its applicability to a difficult-to-pulp hardwood species (e.g., Eucalyptus Regnans).

EXAMPLE 6

Example 5 was repeated using Eucalyptus Regnans chips and with the impregnating solution given below.

The first impregnation solution was an aqueous solution containing 3.96 grams/liter of Epsom salt and 4.0 grams/liter DTPA and having a pH adjusted to 9 with hydrochloric acid. The second impregnation solution was an aqueous solution containing 15.8 grams/liter of sodium silicate, 0.4 grams/liter DTPA and having a pH of 10.7. The third impregnation solution was an aqueous solution containing 3.96 grams/liter of Epsom salt, 15.8 grams/liter of sodium silicate, 0.4 grams/liter DTPA, 60 grams/liter sodium hydroxide and 45 grams/liter hydrogen peroxide, and having a pH of 12.5.

EXAMPLE G

Example E for the CMP process was repeated with the same eucalyptus chips as in Example 6. The cooking and bleaching conditions were as follows:

In the digester, a 4:1 liquor to wood ratio was used at 150° C. for 90 minutes. The cooking liquor had a pH of 9.5 and resulted in 6% $SO_2$ applied to the chips based upon the dry weight of the chips. The post refining peroxide bleaching process employed a pretreated with 0.25% DTPA at a 3% consistency for 10 minutes. After pretreated, the pulp was dewatered and then bleached with a bleaching solution containing 5% hydrogen peroxide, 4.8% sodium hydroxide, 5% sodium silicate, 0.5% DTPA, and 0.05% Epsom salt based upon the dry weight of the chips and having a pH of 10.9. Bleaching was at a consistency of 12.5%.

EXAMPLE H

Example F was repeated but using the same eucalyptus chips used in Example 6 and with digestor treatment and bleaching conditions as follows:

The digester liquor contained 17 grams/liter of $Na_2SO_3$ plus 28 grams/liter sodium hydroxide and had a pH of 12.9 which resulted in 1.3% $SO_2$ and 10.4% sodium hydroxide applied to the chips based upon the dry weight of the chip. The impregnation temperature was 30° C. After impregnation, the chips were drained and steamed for 20 minutes with steam at a pressure of 5 lbs/inch$^2$ gage (saturated). The post refining bleaching solution contained 6% hydrogen peroxide, 5.4% sodium hydroxide, 5% sodium silicate, 0.5% DTPA and 0.05% Epsom salt based upon the dry weight of the chips and had a pH of 11.3.

The pulp of Examples G, H and 6 were tested for brightness, freeness and strength (breaking length) and the results are reported in Table II.

The pulp of Example 6 had the highest brightness and required the least refining energy while its strength was comparable to the high alkalinity CTMP pulp and stronger than the CMP pulp.

EXAMPLES J, K and 7

The preferred three-stage impregnation process of the present invention was compared with conventional CMP with post refiner peroxide bleaching and high alkalinity CTMP with post refiner peroxide bleaching utilizing Gmelina (a tropical hardwood) chips. Examples J, K and 7 were repetitions of Examples E, F and 5 with the exceptions noted below.

Gmelina chips of a size that would pass through a ¾" circular hole screen were pretreated with atmospheric steam for 20 minutes and then washed with water prior to being utilized in Examples J, K and 7.

EXAMPLE 7

Example 5 was repeated with the identical solutions as used in Example 5 but with Gmelina chips rather than Eucalyptus chips.

EXAMPLE J (CMP PROCESS WITH POST PEROXIDE BLEACHING)

Example E was repeated with the same type of Gmelina chips as in Example 7 and with the following cooking and bleaching conditions:

The cooking liquor in the digester was used at a ratio of 4:1 of liquor to chips based on the dry weight of the chips. Cooking was done at 150° C. for 75 minutes and then the cooked chips were drained of free cooking liquor. The cooking liquor contained 37 grams/liter of $Na_2SO_3$ plus 7.4 grams/liter of sodium hydroxide and had a pH of 13. This resulted in 4.4% $SO_2$ and 3% sodium hydroxide applied to the chips based on the dry weight of the chips. The post refining peroxide bleaching treatment was with a solution that contained 5% peroxide, 4.9% sodium hydroxide, 5% sodium silicate, 0.5% DTPA and 0.05% Epsom salt based upon the dry weight of the pulp and had a pH of 11.3. Prior to bleaching, the pulp was pretreated at a 3% consistency with 0.25% DTPA for 10 minutes and then dewatered. After being bleached for 2 hours at 60° C., the pulp was dewatered and diluted to 3% consistency and the pH was adjusted to 5.5 with sulfurous acid.

EXAMPLE K (HIGH ALKALINITY CTMP PROCESS WITH POST PEROXIDE BLEACHING)

Example F was repeated except that the chips were of the same type of Gmelina chips as in Example 7 and with cooking and bleaching conditions as stated below.

The cooking liquor contained 15 grams/liter of $Na_2SO_3$ and 31 grams/liter of sodium hydroxide and had a pH of 13.3. The cooking liquor used in the digester was used at a ratio of 4:1 liquor to chips. The chips were cooked for 45 minutes at 110° C. and then the cooked chips were drained free of cooking liquor. This resulted in 1.3% $SO_2$ and 7.8% of sodium hydroxide applied based upon the dry weight of the chips. The peroxide bleaching solution contained 5% peroxide, 4.9% sodium hydroxide, 5% sodium silicate, 0.5% DTPA, and 0.05% Epsom salt and at a pH of 11.3. Prior to bleaching, the pulps was pretreated at a 3% consistency with 0.25% DTPA for 10 minutes and then dewatered.

The pulps of Examples J, K and 7 were tested for brightness, freeness and strength and the energy required to refine the pulps was also determined. The results are given in Table II. The pulp of Example 7 was the brightest and required and the least refining energy although all three pulps had comparable tensile strength. The process of the present invention is capable of achieving novel non-sulfonated pulp having properties not previously achievable. A non-sulfonated pine pulp can be produced for the first time from Pine having a Yield greater than 85%, a Brightness greater than 70% and a Papermaking Strength of at least 3.0 km when refined to a Freeness of 600 ml. A non-sulfonated Aspen pulp can be produced having a Yield greater than 80%, a Brightness greater than 80% and a Papermaking Strength of at least 4.0 km when refined to a freeness of 500 ml. A non-sulfonated Eucalyptus pulp can be produced having a Yield greater than 80%, a Brightness greater than 80% and a Papermaking Strength of at least 3.0 km when refined to a Freeness of 500 ml. A non-sulfonated Gmelina pulp can be produced having a Yield greater than 80%, a Brightness greater than 75% and a Papermaking Strength of at least 2.0 km when refined to a Freeness of 500.

TEST PROCEDURES AND DEFINITIONS

Hydrogen peroxide usage or consumption (expressed as a weight percent based on the dry weight of the chips) is the quantity of peroxide consumed from the impregnation solution (initial peroxide in the impregnating solution minus final peroxide in the impregnation solution) minus the quantity of residual peroxide in the pulp after refining if followed by a refining step or after bleaching when using post-refiner bleaching. The percentage peroxide consumed is calculated as being equal to the quantity of peroxide consumed times 100 divided by the dry weight of the chips or pulp fibers. The quantity of peroxide in a solution was determined by iodometric titration using starch as an end point indicator.

"Brightness" is defined as Elrepho brightness in percent units which is determined by using the sample preparation procedure given in the Technical Association of the Pulp and Paper Industry (TAPPI) Official Test Method T218 om-83. The brightness of the sample was measured using TAPPI Provisional Method T525 su-72.

Refining energy (net refining energy) is expressed in horsepower days per ton (HPD/T) and is the total energy absorbed by the fibers and associated fluids during refining. It is determined by measuring the total energy input into the refiner during refining and substracting the energy required to operate the refiner without chips being fed to the refiner (usually referred to as the idle energy required for the refiner). In small laboratory equipment, the idle energy is usually significant and must be taken into account. In large industrial equipment it is usually insignificant and not taken into account in determining the energy for refining.

"Freeness" is defined as Canadian Standard Freeness (CSF) which is measured in milliliters (ml) and was determined in accordance with TAPPI Official Test Method T227 os-58.

"Papermaking Strength" is defined as breaking length (measure of papermaking tensile strength) which is measured in kilometers (km) and is a measure of the maximum length of a paper sheet that is self supporting. The paper sheet was prepared using the sample preparation procedure given in TAPPI Official Test Method T205 om-81, the test specimen of the paper sheet was prepared using the sample preparation procedure given in TAPPI Official Test Method T220 om-83, and the strength measurement of the test specimen was determined by using the procedure given in TAPPI Official Test Method T494 om-81.

"Yield" is a percentage and is defined as the dry weight of pulp times 100 divided by the dry weight of the chips from which the pulp was made.

TABLE I

| Ex. No. | Wood Type | No. of Impregnation Steps | Total $H_2O_2$ Usage | Elrepho Brightness |
|---|---|---|---|---|
| A | Pine | 1 | 7.5 | 60 |
| 1 | Pine | 2 | 1.2 | 72 |
| 2 | Pine | 3 | 3.7 | 75 |
| D | Aspen | 1 | 4.7 | 76 |
| 4 | Aspen | 2 | 3.4 | 82 |
| 5 | Aspen | 3 | 1.5 | 83 |

TABLE II

| Ex. No. | Process | Elrepho Brightness Initial[5] | Elrepho Brightness Bleached | Refining Energy Net HPD/T | Canadian Standard Freeness ml. | Breaking Length, km. |
|---|---|---|---|---|---|---|
| Southern Pine | | | | | | |
| B | CMP | 59 | 67[1] | 66 | 720 | 2.8 |
| C | CTMP | 54 | 66[1] | 49 | 750 | * |
| 3 | Invention | 70 | — | 43 | 730 | 2.2 |
| Aspen | | | | | | |
| E | CMP | 58 | 75[2] | 72 | 650 | 1.2 |
| F | CTMP | 42 | 60[2] | 22 | 610 | 2.5 |
| 5 | Invention | 83 | — | 39 | 620 | 2.8 |
| Eucalyptus | | | | | | |
| G | CMP | 43 | 79[3] | 101 | 600 | 1.0 |
| H | CTMP | 41 | 67[3] | 32 | 530 | 2.8 |
| 6 | Invention | 82 | — | 30 | 530 | 2.6 |
| Gmelina | | | | | | |
| J | CMP | 45 | 68[4] | 72 | 510 | 2.2 |
| K | CTMP | 38 | 54[4] | 67 | 510 | 2.2 |

TABLE II-continued

| Ex. No. | Process | Elrepho Brightness Initial[5] | Elrepho Brightness Bleached | Refining Energy Net HPD/T | Canadian Standard Freeness ml. | Breaking Length, km. |
|---|---|---|---|---|---|---|
| 7 | Invention | 78 | — | 62 | 490 | 2.2 |

[1]Bleached brightness with same peroxide consumption as Ex. 3, 3,4% $H_2O_2$ on dry weight of wood.
[2]Bleached brightness with same peroxide consumption as Ex. 5, 1.5% $H_2O_2$ on dry weight of wood.
[3]Bleached brightness with same peroxide consumption as Ex. 6, 3.0% $H_2O_2$ on dry weight of wood.
[4]Bleached brightness with same peroxide consumption as Ex. 7, 3.0% $H_2O_2$ on dry weight of wood.
[5]Initial brightness after refining.
*Too weak to test (less than 0.5).

We claim:

1. A high yield pulping process for lignocellulosic material in chip form comprising:

(a) impregnating the chips with a first impregnation solution containing stabilizing chemicals for peroxide under conditions of pH, temperature and concentration for the stabilizing chemicals such that they are in solution in the first impregnation solution; and, wherein said first impregnation solution has a pH between 5 and 10 and contains;

(i) water soluble magnesium salts in a concentration of between 0.01 gram per liter and 2.0 grams per liter based upon the weight of magnesium, and (ii) a chelating agent for metal contaminants selected from diethylene triaminepentaacetic acid, ethylene diaminetetraacetic acid, hydroxyethylethylenediaminetriacetic acid, nitrilotriacetic acid, sodium tripolyphosphate or phosphonic acid derivatives at a concentration of chelant in the first impregnation solution of from 0.01 gram per liter to 20 grams per liter;

(b) impregnating the chips with a second impregnation solution containing stabilizing chemicals for peroxide under conditions of pH, temperature and concentration preselected to provide:

(i) conditions under which the chemicals in said second impregnation solution are in solution in the second impregnation solution; and (ii) when said second solution is mixed with the first impregnation solution within the chips, the mixture results in conditions under which one or more of the stabilizing chemicals in solution in the combination of the first and second impregnation solutions precipitate or form a flock for stabilizing peroxide within the chips; and, wherein said second impregnation solution has a pH that is higher than the pH of the first impregnation solution and between 9 and 12 and contains;

(i) sodium silicate in a concentration between 1.0 gram per liter and 100 grams per liter of silicates calculated and expressed as silicon dioxide, and (ii) a chelating agent for metal ions selected from diethylene triaminepentaacetic acid, ethylene diaminetetra acetic acid, hydroxyethylethylenediaminetriacetic acid, nitrilotriacetic acid, sodium tripolyphosphate or phosphonic acid, sodium tripolyphosphate or phosphonic acid deriatives at a concentration of from 0.01 gram per liter to 20 grams per liter;

(c) impregnating the chips with a third impregnation solution having a pH between 11 and 13 and containing peroxide in a concentration of from 10 grams per liter to 100 grams per liter calculated as hydrogen peroxide to result in between 0.5% and 10% peroxide calculated as hydrogen peroxide and based upon the dry weight of the chips;

(d) the impregnations of the chips are at a temperature between 15° C. and 100° C.;

(e) the first impregnation results in a magnesium content in the chips between 0.001% and 0.2% upon the dry weight of the chips and in a chelant content in the chips of from 0.01% to 2.0% chelant based upon the dry weight of the chips;

(f) the second impregnation of the chips results in from 0.01% to 2.0% chelant based upon the dry weight of the chips and between 0.1% and 10% silicates based upon the dry weight of the chips; and (g) mechanically refining the alkaline peroxide impregnated chips to produce pulp.

2. The process of claim 1 wherein the lignocellulosic material is selected from softwood, hardwood, Pine, Spruce, Aspen, Euclyptus, Gmelina, Beech, Oak, Ash, Fir, Hemlock, bagasse and straw.

3. The process of claim 1 wherein the pulp is concentrated after refining to remove residual impregnation solution and said residual impregnation solution is recycled as a source of peroxide for use in said third impregnation solution.

4. A high yield pulping process for lignocellulosic material in chip form comprising:

(a) impregnating the chips with a first impregnation solution containing stabilizing chemicals for peroxide under conditions of pH, temperature and concentration for the stabilizing chemicals such that they are in solution in the first impregnation solution; and, wherein said first impregnation solution has a pH between 5 and 10 and contains;

(i) water soluble magnesium salts in a concentration of between 0.01 gram per liter and 2.0 grams per liter based upon the weight of magnesium, and (ii) a chelating agent for metal contaminants selected from diethylene triaminepentaacetic acid, ethylene diaminetetraacetic acid, hydroxyethylethylenediaminetriacetic acid, nitrilotriacetic acid, sodium tripolyphosphate or phosphonic acid derivatives at a concentration of chelant in the first impregnation solution of from 0.01 gram per liter to 20 grams per liter;

(b) impregnating the chips with a second impregnation solution containing alkaline peroxide and stabilizing chemicals for peroxide under conditions of pH, temperature and concentration preselected to provide;

(i) conditions under which the chemicals in said second impregnation solution are in solution in the second impregnation solution, and (ii) when said second solution is mixed with the first impregnation solution within the chips, the mixture results in conditions under which one or more of the stabilizing chemicals in solution in the combination of the first and second impregnation solutions precipitate or form a flock for stabilizing peroxide within the chips; and, wherein said second impregnation solution has a pH that is higher than the pH of the first impregnation solution and between 9 and 13 and contains;

(i) sodium silicate in a concentration between 1.0 gram per liter and 100 grams per liter of silicates calculated and expressed as silicon dioxide, (ii) a chelating agent for metal ions selected from diethylene triaminepentaacetic acid, ethylene diaminetetra acetic acid, hydroxyethylethylenediaminetriacetic acid, nitrilotriacetic acid, sodium tripolyphosphate or phosphonic acid derivatives at a concentration of chelant of from 0.01 gram per liter to 20 grams per liter, (iii) peroxide in a concentration of from 10 grams per liter to 100 grams per liter caluclated as hydrogen peroxide to result in between 0.5% and 10% peroxide calculated as hydrogen peroxide and based upon the dry weight of the chips, and (iv) a water soluble magnesium salt in a concentration of between 0.01 gram per liter and 2.0 grams per liter based upon the weight of magnesium.

(c) the impregnations of the chips are at a temperature between 15° C. and 100° C.;

(d) the first impregnation results in a magnesium content in the chips between 0.001% and 0.2% based upon the dry weight of the chips and in a chelant content in the chips of from 0.01% to 2.0% chelant based upon the dry weight of the chips;

(e) the second impregnation of the chips results in from 0.1% to 10% silicate, from 0.01% to 2.0% chelant, and from 0.5% to 10% peroxide based upon the dry weight of the chips; and (f) mechanically refining the alkaline peroxide impregnated chips to produce pulp.

5. The process of claim 4 wherein the lignocellulosic material is selected from softwood, hardwood, Pine, Spruce, Aspen, Eucalyptus, Gmelina, Beech, Oak, Ash, Fir, Hemlock, bagasse and straw.

6. The process of claim 4 wherein the pulp is concentrated after refining to remove residual impregnation solution and said residual impregnation solution is recycled as a source of peroxide for use is said third impregnation solution.

7. A high yield pulping process for lignocellulosic material in chip form comprising:

(a) impregnating the chips with a first impregntaion solution containing stabilizing chemicals for peroxide under conditions of pH, temperature and concentration for the stabilizing chemicals such that they are in solution in the first impregnation solution; and, wherein said first impregnation solution has a pH that is higher than the pH of the second impregnation solution and between 9 and 12 and contains;

(i) sodium silicate in a concentration between 1.0 gram per liter and 100 grams per liter of silicates calculated and expressed as silicon dioxide, and (ii) a chelating agent for metal ions selected from diethylene triaminepentaacetic acid, ethylene diaminetetra acetic acid, hydroxyethylethylenediaminetriacetic acid, nitrilotriacetic acid, sodium tripolyphosphate or phosphonic acid derivatives at a concentration of chelant in the first impregnation solution of from 0.01 gram per liter to 20 grams per liter;

(b) impregnating the chips with a second impregnation solution containing stabilizing chemicals for peroxide under conditions of pH, temperature and concentration preselected to provide;

(i) conditions under which the chemicals in said second impregnation are in solution in the second impregnation solution; and (ii) when said second solution is mixed with the first impregnation solution within the chips, the mixture results in conditions under which one or more of the stabilizing chemicals in solution in the combination of the first and second impregnation solutions percipltate or form a flock for stabilizing peroxide within the chips; and, wherein said second impregnation solution has a pH between 5 and 10 and contains;

(i) water soluble magnesium salts in a concentration of between 0.01 gram per liter and 2.0 grams per liter based upon the weight of magnesium, and (ii) a chelating agent for metal contaminants selected from diethylene triaminepentaacetic acid, ethylene diaminetetraacetic acid, hydroxyethylethylenediaminetriacetic acid, nitrilotriacetic acid, sodium tripolyphosphate or phosphonic acid derivatives at a concentration of chelant of from 0.01 gram per liter to 20 grams per liter;

(c) the impregnations of the chips are at a temperature between 15° C. and 100° C.

(d) the first impression of the chips results from 0.01% to 2.0% chelant based upon the dry weight of the chips and between 0.1% and 10% silicates based upon the dry weight of the chips;

(e) the second impregnation results in a magnesium content in the chips between 0.001% and 0.2% based upon the dry weight of the chips and in a chelant content in the chips of from 0.01% to 2.0% based upon the dry weight of the chips;

(f) impregnating the chips with a third impregnation solution containing alkaline peroxide and having a pH between 11 and 13 and containing peroxide in a concentration of from 10 grams per liter to 100 grams per liter calculated as hydrogen peroxide to result in between 0.5% and 10% peroxide calculated as hydrogen peroxide and based upon the dry weight of the chips and containing a stabilizer for peroxide; and, (g) mechanically refining the alkaline peroxide impregnated chips to produce pulp.

8. The process of claim 7 wherein the stabilizer contained in the third impregnation solution is selected from magnesium and silicate stabilizers for peroxide and a chelating agent for stablizing against decomposition from metal ions.

9. The process of claim 7 wherein the lignocellulosic material is selected from softwood, hardwood, Pine, Spruce, Aspen, Eucalyptus, Gmelina, Beech, Oak, Ash, Fir, Hemlock, bagasse and straw.

10. The process of claim 7 wherein the pulp is concentrated after refining to remove residual impregnation solution and said residual impregnation solution is recycled as a source of peroxide for use in said third impregnation solution.

* * * * *